US005433184A

United States Patent [19]

Kinoshita et al.

[11] Patent Number: 5,433,184

[45] Date of Patent: Jul. 18, 1995

[54] CAPACITOR DISCHARGE TYPE IGNITION SYSTEM FOR INTERNAL COMBUSTION ENGINE

[76] Inventors: Atsufumi Kinoshita, 86-10 Shimonagakubo, Nagaizumi-cho, Suntou-gun; Kenji Kimura, 330 Honjuku, Nagaizumi-cho, Suntou-gun, both of Shizuoka-ken, Japan

[21] Appl. No.: 104,988

[22] Filed: Aug. 10, 1993

[51] Int. Cl.[6] ..... F02P 3/06

[52] U.S. Cl. ..... 123/602

[58] Field of Search ..... 123/602, 597, 656, 644

[56] References Cited

U.S. PATENT DOCUMENTS

| | | | |
|---|---|---|---|
| 3,718,125 | 2/1973 | Posey | 123/644 |
| 4,097,770 | 6/1978 | Fisher | 123/597 |
| 4,149,508 | 4/1979 | Kirk, Jr. et al. | 123/644 |
| 4,345,575 | 8/1982 | Jorgensen | 123/656 |
| 4,380,989 | 4/1983 | Takaki | 123/597 |
| 4,610,237 | 9/1986 | Inoescu et al. | 123/602 |
| 4,722,311 | 2/1988 | Erhard | 123/602 |
| 4,922,883 | 5/1990 | Iwasaki | 123/656 |
| 5,060,623 | 10/1991 | McCoy | 123/644 |
| 5,131,376 | 7/1992 | Ward et al. | 123/597 |
| 5,197,448 | 3/1993 | Porreca et al. | 123/656 |
| 5,215,066 | 6/1993 | Narishige et al. | 123/597 |

FOREIGN PATENT DOCUMENTS

| | | | |
|---|---|---|---|
| 452 | of 1978 | Japan | 123/644 |
| 204968 | of 1985 | Japan | 123/644 |

*Primary Examiner*—Raymond A. Nelli

[57] ABSTRACT

A capacitor discharge type ignition system for an internal combustion engine capable of rendering rising of a secondary voltage rapid, prolonging a duration of a secondary discharge current, and preventing a reduction in output of an engine by incomplete combustion due to a decrease in concentration of fuel. A switching element which is rendered forcibly non-conductive such as an FET 6 is used as a discharge switch for carrying out discharge of an ignition energy accumulating capacitor 2. When an ignition signal Vi for determining each of ignition timings is generated, the FET is fed a trigger signal Vt to render the FET turned on, to thereby charges in the capacitor to be discharged through the FET to a primary winding 1*a* of an ignition coil 1. When the discharge current reaches a set value, the trigger signal is caused to be zero to render the FET turned off to interrupt discharge of the capacitor. Then, when a certain period of time elapses, the FET is fed with the trigger signal to restart discharge of the capacitor.

2 Claims, 5 Drawing Sheets

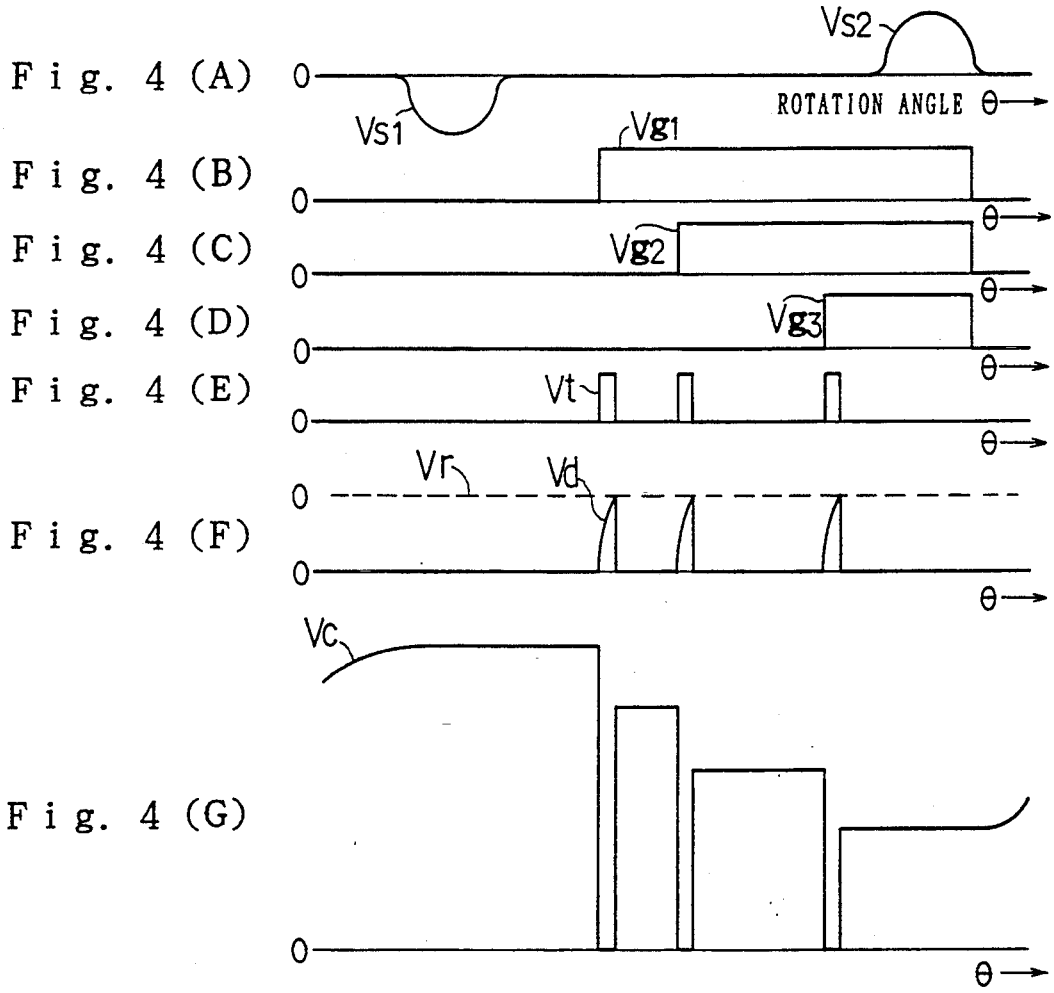
Fig. 4 (A)
Fig. 4 (B)
Fig. 4 (C)
Fig. 4 (D)
Fig. 4 (E)
Fig. 4 (F)
Fig. 4 (G)
Vs1
Vs2
Vg1
Vg2
Vg3
Vt
Vr
Vd
Vc
0
ROTATION ANGLE θ
θ
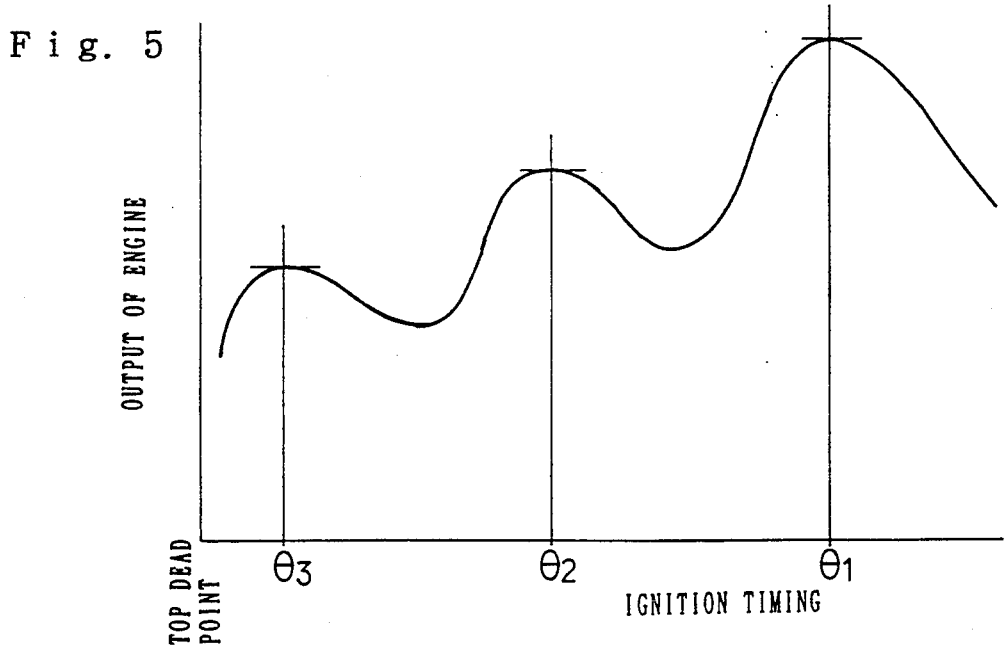
Fig. 5
OUTPUT OF ENGINE
TOP DEAD POINT
θ3
θ2
θ1
IGNITION TIMING Vs2

ROTATION ANGLE θ→
Vs1
Vi

θ→
Vd1

θ→
Vd2

θ→
Vc

θ→

CAPACITOR DISCHARGE TYPE IGNITION SYSTEM FOR INTERNAL COMBUSTION ENGINE

BACKGROUND OF THE INVENTION

This invention relates to an ignition system for an internal combustion engine, and more particularly to a capacitor discharge type ignition system for an internal combustion engine.

In general, an internal combustion engine tends to cause a concentration of fuel to be reduced at the time of quick acceleration of the engine as compared with at the time of its normal or steady operation, because the concentration is adjusted at each of engine speeds in view of steady operating conditions of the engine. In particular, an internal combustion engine used for a vehicle for motocross or a racing car is frequently subject to quick acceleration or quick deceleration. During a transient state such as quick acceleration, quick deceleration or the like, a concentration of fuel is considerably deviated from its ideal concentration.

As described above, a decrease in concentration of fuel causes incomplete combustion after ignition of the engine, resulting in the engine failing to exhibit a sufficient output. Thus, although, in a bench test, the engine exhibits a sufficient output over a range of from a high engine speed region to a high engine speed region, it fails to exhibit a sufficient output at the time of quick acceleration in a test which causes a vehicle to run while mounting the engine on the vehicle.

In particular, when a capacitor discharge type ignition system wherein charges in a capacitor for accumulating ignition energy are discharged to a primary winding of an ignition coil to induce a high voltage for ignition of the engine is used for an internal combustion engine, it is possible to obtain a secondary voltage rapidly rising. However, this fails to permit a duration of a discharge current of the capacitor to be increased, to thereby cause incomplete combustion when a concentration of fuel is reduced at the time of quick acceleration of the engine.

Recently, an internal combustion engine tends to employ, with an increase in tightening of control of exhaust gas, a lean combustion system which is an ignition system adapted to carry out combustion using fuel of a reduced concentration. For this purpose, it is required to construct the ignition system so as to permit a secondary voltage across the ignition coil to rapidly rise and a duration of a secondary discharge current (spark current) to be increased.

In view of the above, such an ignition system as disclosed in Japanese Patent Publication No. 452/1978 (53-452) was proposed, which comprises a combination of a capacitor discharge type ignition system constructed so as to permit a duration of a secondary discharge current to be reduced while rendering rising of a secondary voltage rapid and a battery interruption type ignition system constructed so as to permit a duration of a secondary discharge current to be increased while rendering rising of a secondary voltage slow and adapted to interrupt a current fed from a battery to a primary winding of an ignition coil to provide a high voltage. In the proposed ignition system in which the capacitor discharge type ignition system and the battery interruption type ignition system are combined, it is required to increase the number of turns of a primary winding of an ignition coil to a level as large as 200 to 300. This requires to increase a size of a core, leading to large-sizing of the ignition coil.

In order to avoid the problem, a capacitor discharge type ignition system was then proposed which is constructed in such a manner as taught in Japanese Patent Application Laid-Open Publication No. 204968/1985 (60-204968). More particularly, the ignition system proposed includes two sets of capacitor discharge circuits each comprising a capacitor for accumulating ignition energy therein and a discharge switch adapted to discharge charges in the capacitor to a primary winding of an ignition coil and is adapted to carry out dual ignition.

In the ignition system proposed, discharge of one of the capacitors takes place at a normal ignition position, to thereby cause a first ignition operation to be carried out and then discharge of the other capacitor is attained at a position slightly delayed on the basis of the normal ignition position, leading to a second ignition operation. This results in increasing an apparent duration of discharge and preventing incomplete combustion due to a decrease in concentration of fuel.

The conventional capacitor discharge type ignition system intended to carry out dual ignition requires two sets of combinations of capacitors and switches for discharge of the capacitors, resulting in being complicated in structure.

Also, in the ignition system, the two ignition energy accumulating capacitors must be charged, so that it is required to increase a capacity of a power supply used for charging the capacitors. Unfortunately, this causes large-sizing of the system conjointly with the fact that two capacitors and two switches are required.

Techniques for carrying out multiple ignition in a capacitor discharge type ignition system for an internal combustion engine are disclosed in U.S. Pat. Nos. 3,718,125 and 4,149,508 as well.

SUMMARY OF THE INVENTION

The present invention has been made in view of the foregoing disadvantages of the prior art.

Accordingly, it is an object of the present invention to provide a capacitor discharge type ignition system for an internal combustion which is capable of exhibiting characteristics which permit a secondary voltage to rapidly rise and a duration of a secondary discharge current to be increased while preventing large-sizing of the system.

It is another object of the present invention to provide a capacitor discharge type ignition system for an internal combustion engine which is capable of preventing incomplete combustion of the engine even when a concentration of fuel is decreased.

It is a further object of the present invention to provide a capacitor discharge type ignition system for an internal combustion engine which is capable of carrying out multiple ignition to prevent a decrease in output of the engine at the time of quick acceleration of the engine while preventing large-sizing of the system.

In accordance with the present invention, a capacitor discharge type ignition system for an internal combustion engine is provided. The ignition system includes an ignition energy accumulating capacitor arranged on a primary side of an ignition coil, a capacitor charging circuit for charging the ignition energy accumulating capacitor with electric charges and a discharge switch for discharging charges in the ignition energy accumulating capacitor to a primary winding of the ignition coil when it is rendered conductive.

Principally, the present invention is to interrupt discharge of the ignition energy accumulating capacitor when a discharge current of the capacitor reaches a predetermined value after discharge of the capacitor starts and restart discharge of the ignition energy accumulating capacitor when a certain period of time elapses after the interruption of discharge of the capacitor. The number of times or frequency of repeating of the discharge may be determined as desired.

When charges accumulated in the ignition energy accumulating capacitor are discharged to the primary winding of the ignition coil, a voltage rapidly rising is induced on a secondary side of the ignition coil. When discharge of the capacitor is interrupted when a discharge current of the capacitor reaches a predetermined value, a high voltage of a polarity which is to further continue flowing of the current is induced across the primary winding of the ignition coil. Ignition performance of the capacitor discharge type ignition system (or a secondary output of the ignition coil) is determined substantially depending on a variation in current in the course during which a primary current of the ignition coil rises toward a peak. When the primary current is then increased to a degree sufficient to cause a magnetic flux in a core to be saturated, a decrease in secondary output of the ignition coil starts thereafter. Therefore, in order to enhance energy efficiency thereof, it is convenient to interrupt discharge of the capacity when a discharge current of the ignition energy accumulating capacitor reaches a predetermined value. Thus, when first discharge of the ignition energy accumulating capacitor is discontinued or interrupted, a sufficient amount of electric charges still remain in the capacitor, to thereby render subsequent discharge of the capacitor possible. In view of such a fact, the present invention is constructed so as to interrupt discharge of the ignition energy accumulating capacitor when a discharge current of the capacitor reaches a predetermined value or level and the discharge is restarted when a certain period of time elapses thereafter. Such construction of the present invention permits a rapidly rising voltage to be continuously induced on a secondary side of the ignition coil plural times, to thereby significantly increase a duration of the discharge. Thus, the present invention permits complete combustion to be fully carried out even when a concentration of fuel is reduced.

More particularly, in accordance with the present invention, a capacitor discharge type ignition system for an internal combustion engine is provided, which generally includes an ignition signal generating unit for generating ignition signals for determining ignition timings of the internal combustion engine, a discharge current detecting circuit for detecting a discharge current of an ignition energy accumulating capacitor, and a discharge switch control circuit for controlling a discharge switch. The discharge switch detecting circuit is constructed so as to render the discharge switch conductive to start discharge of the ignition energy accumulating capacitor when the ignition signal is generated, render the discharge switch non-conductive to interrupt discharge of the ignition energy accumulating capacitor when the discharge current detected by the discharge current detecting circuit reaches a predetermined value, and render the discharge switch conductive again to restart discharge of the ignition energy accumulating capacitor when a certain period of time elapses after the discharge switch is rendered non-conductive.

"A certain period of time" used herein extends from a point at which the discharge switch is interrupted to a point at which it is rendered re-conductive and may be a fixed period of time. Alternatively, it may be a non-fixed period of time.

When the certain period of time is rendered variable or non-fixed, the ignition system of the present invention may be so constructed that a damper diode is connected in parallel to a primary winding of the ignition coil, resulting in the certain period of time being determined to be a period of time extending from a point at which a current starts to flow through the damper diode to a point at which the current flowing through the damper diode reaches a reference value or less. The damper diode is connected in a direction which permits a voltage induced across the primary winding of the ignition coil when the discharge current of the capacitor reaches a level of zero (0) to be applied in a forward direction. A damper diode which has been used in the conventional capacitor discharge type ignition system may be used for this purpose.

In this instance, the discharge switch control circuit may comprise a trigger signal feed circuit for feeding the discharge switch with a trigger signal when the ignition signal is generated, a discharge interruption command circuit for generating a discharge interruption command signal when a detection output of the discharge current detecting circuit reaches a predetermined value, and a discharge restart command circuit for detecting the current flowing through the damper diode, to thereby generate a discharge restart command signal when the current flowing through the damper diode reaches the reference value or less, and a trigger signal feed control circuit for rendering the discharge switch non-conductive when the discharge interruption command signal is generated and rendering the discharge switch conductive when the discharge restart command signal is generated.

When discharge of the capacitor is interrupted when the discharge current of the capacitor reached the predetermined value, a high voltage of a polarity which is to further continue flowing of the current is induced across the primary winding of the ignition coil. The voltage is then applied to the damper diode, to thereby permit a primary current for the ignition coil to continue to flow through the damper diode. On a secondary side of the ignition coil, a secondary discharge current flows through an ignition plug. The discharge current is substantially proportional to the current flowing through the damper diode. Thus, detection of the current flowing through the damper diode results in the secondary discharge current being estimated. When the discharge switch is rendered conductive again or reconductive when the current flowing the damper diode reaches the reference value or below or the secondary discharge current reaches the predetermined value or below charges remaining in the ignition energy accumulating capacitor are discharged to the primary winding of the ignition coil, so that a voltage rapidly rising may be induced again on the secondary side of the ignition coil. When discharge of the capacitor is interrupted when the discharge current of the capacitor reaches the predetermined value, a high voltage is induced across the primary winding of the ignition coil, resulting in a current flowing through the damper diode. It is possible to repeat such operation until the ignition energy accumulating capacitor is emptied of charges. Repeating of the operation permits the secondary voltage rapidly rising to be repeatedly generated and a duration of the secondary voltage to be increased.

It is desirable that the interruption of discharge of the ignition energy accumulating capacitor is carried out at the time when the discharge current reaches its peak value. More particularly, a secondary induced voltage of the ignition coil is increased with an increase in ratio of variation in discharge current for a period of time until the discharge current of the ignition energy accumulating capacitor reaches the peak value; however, a variation in discharge current after it is beyond the peak value scarcely contributes to the secondary induced voltage, therefore, it is merely necessary to carry out discharge before the discharge current reaches the peak.

The capacitor discharge type ignition system of the prior art as well as that of the present invention is provided with such a damper diode as described above; however, it is constructed so as to carry out discharge of an ignition energy accumulating capacitor at a stretch, therefore, it fails to exhibit the above-described advantages of the present invention. More specifically, it is a rising portion of a discharge current that contributes to a secondary induced voltage of an ignition coil; therefore, when discharge of the capacitor is carried out at a stretch, inducing of the secondary voltage rapidly rising is carried out only one time at the time of starting of the discharge. Also, in the conventional ignition system, the damper diode merely functions to short-circuit a voltage induced across a primary winding of the ignition coil when discharge of the capacitor is completed, to thereby flow a secondary discharge current for only a slight period of time. On the contrary, when discharge of the capacitor is intermittently carried out plural times as in the present invention, it is possible to increase a duration of the secondary discharge current while repeatedly inducing the secondary voltage rapidly rising. Thus, the present invention significantly improves ignition performance as compared with the prior art.

Alternatively, "the certain period of time" described above may be determined by intervals at which a plurality of ignition signals are intermittently generated during one ignition operation. For example, the ignition signal generating unit may be constructed so as to operate a plurality of ignition timings substantially coinciding with ignition timings which cause peaks to be produced in an output of the internal combustion engine in at least a part of engine speed regions, to thereby generate a plurality of ignition signals corresponding to the plural ignition timings. Also, the discharge switch control circuit may be constructed so as to render the discharge switch conductive by means of first one of the plural ignition signals to start discharge of the ignition energy accumulating capacitor, render the discharge switch non-conductive to interrupt discharge of the ignition energy accumulating capacitor when the discharge current detected by the discharge current detecting circuit reaches the predetermined value, and renders the discharge switch conductive again by means of the remaining part of the ignition signals to restart discharge of the ignition energy accumulating capacitor. More specifically, the ignition signal generating unit may comprise an engine speed detecting means for detecting engine speeds of the internal combustion engine and a map storing means in which first to n-th (n: integer of 2 or more) maps for defining n kinds of relationships between the engine speeds and the ignition timings are stored. The first to n-th maps are prepared so as to permit the ignition timings defined by the respective maps to coincide with the ignition timings which cause peaks to be produced in an output of the internal combustion engine. Also, the ignition signal generating unit may further comprise an ignition timing operation means for operating the ignition timing defined by each of the maps with respect to each of the engine speeds by means of the first to n-th maps and an ignition signal generating means for generating an ignition signal at each of the ignition timings operated by the ignition timing operation means.

In order to prepare the first to n-th maps, a relationship between an output of the engine and each of the ignition timings is actually measured for each of various engine speeds of the internal combustion engine while keeping each engine speed constant. Then, relationships between ignition timings $\theta 1$, $\theta 2$, ---, $\theta n$ which cause peaks to be produced in the output of the engine and the engine speeds are obtained on the basis of results of the measurement. In a certain internal combustion engine, n is set to be three (3), and relationships between the ignition timings $\theta 1$, $\theta 2$ and $\theta 3$ and engine speeds N are, for example, as shown in FIG. 3. The relationships thus obtained by the above-described actual measurement are used to prepare the first to n-th maps for determining the ignition timings $\theta 1$, $\theta 2$, ---, $\theta n$ in each of the engine speeds.

In search for the relationships between the ignition timings $\theta 1$, $\theta 2$, --- and the engine speeds N, an increase in the number of engine speeds to be measured permits precision of the maps to be increased. However, it is actually impossible to obtain experimental data for all engine speeds, therefore, it is unavoidable that ignition timings obtained by the maps for each of engine speeds which have not been actually measured each are an approximate value. Even among internal combustion engines of the same type, there necessarily exists a variation in characteristics, thus, it would be supposed that there occurs an error in the ignition timings which were to have been set so as to cause peaks to be produced in an output of the engine, depending on the engines. Also, it is not necessarily required that multiple ignition at ignition timings which cause peaks to be produced in an output of the engine is carried out in all engine speed regions. In an engine speed region in which it is not required to prevent a decrease in output of the engine, ignition may be carried out only one time at an ignition position specified depending on the engine speed. Further, in order to accomplish the above-described objects of the present invention, it is not necessarily required, in an engine speed region in which it is required to prevent a decrease in output of the engine, to carry out ignition at ignition timings strictly coinciding with the ignition timings which cause peaks to be produced in an output of the engine. Instead, it is merely required to carry out ignition near the ignition timings which cause peaks to be produced in an output of the engine. In order to clarify that such situations are also included in the scope of the present invention, it is defined herein that ignition timings "substantially coincide with" the ignition timings which cause peaks to be produced in an output of the engine "in at least a part of engine speed regions".

Also, the present invention cover a case that the ignition timings provided by the above-described first to n-th maps are equal to each other.

Experimental data on relationships between an output of an internal combustion engine and ignition timings of the engine which were obtained while keeping an engine speed of the engine constant frequently indicate that there exist about three ignition timings which cause peaks to be produced in the output. More particularly, results of the experiment which was carried out for obtaining the relationships between the output and the ignition timings while keeping the engine speed constant, as shown in FIG. 5, frequently indicate that peaks are produced in the output at three ignition timings $\theta 1$, $\theta 2$ and $\theta 3$, wherein $\theta 1$ to $\theta 3$ are angles measured on an advanced side based on a top dead point of the engine and are set so as to meet requirements of $\theta 1 > \theta 2 > \theta 3$. In this instance, when an ignition system is constructed so as to permit an ignition operation to be carried out at each of the three ignition timings $\theta 1$ to $\theta 3$, such construction prevents an output of the engine from being substantially reduced, so far as ignition of the engine is accomplished at the second ignition timing $\theta 2$ or third ignition timing $\theta 3$ even when the ignition at the first ignition timing $\theta 1$ is failed. In view of the above, the present invention employs the maps of n in number which provide relationships between engine speeds of the engine and its ignition timings to operate a plurality of ignition timings substantially coinciding with ignition timings which cause peaks to be produced in an output of the engine in at least a part of engine speed regions in which it is required to prevent a decrease in output of the engine, to thereby generate ignition signals at the plural ignition timings. Multiple ignition is accomplished by controlling the discharge switch in a manner to render the discharge switch conductive when each of the ignition signals is generated and render it non-conductive when the discharge current detected by the discharge current detecting circuit reaches a predetermined value.

As described above, the present invention is constructed so as to operate a plurality of ignition timings substantially coinciding with ignition timings which cause peaks to be produced in an output of the engine to render the discharge switch conductive at each of the plural ignition timings, leading to multiple ignition. Such construction permits sparks for multiple ignition to be generated at ignition timings substantially coinciding with ignition timings which cause peaks to be produced in an output of the engine, to thereby effectively prevent the output from being reduced at the time of quick acceleration of the engine which causes a concentration of fuel to be decreased.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIGS. 4(A) to 4(G) each are a waveform chart showing a waveform of a voltage at each of parts of the ignition system shown in FIG. 1;

FIG. 5 is a diagram showing an example of experimental data indicating relationships between ignition timings of an internal combustion engine and its output;

DETAILED DESCRIPTION OF THE PREFERRED EMBODIMENTS

Now, a capacitor discharge type ignition system for an internal combustion engine according to the present invention will be described hereinafter with reference to the accompanying drawings.

Figure 1:
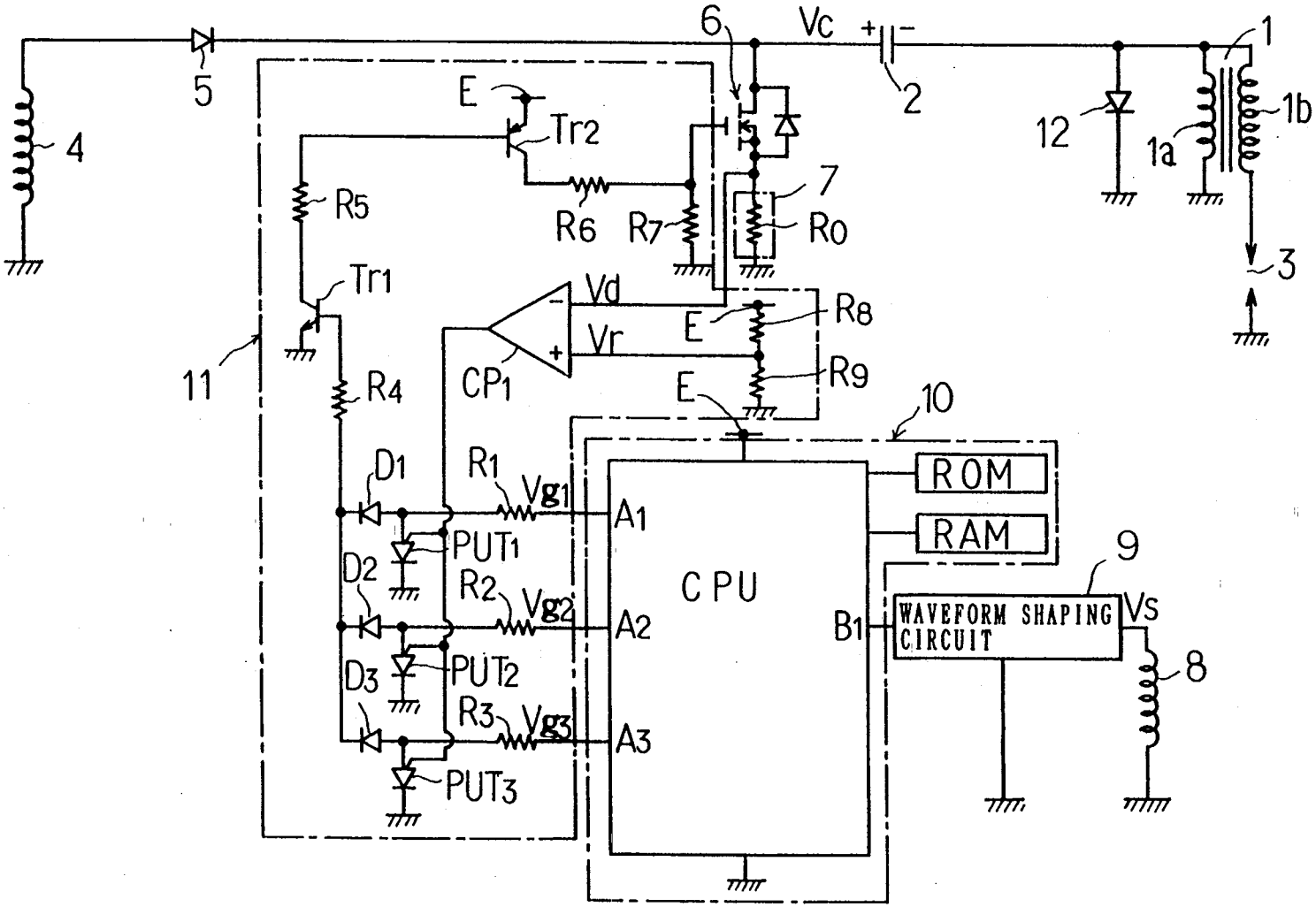
FIG. 1 is a circuit diagram showing an embodiment of a capacitor discharge type ignition system for an internal combustion engine according to the present invention.

Referring first to FIG. 1 showing an embodiment of a capacitor discharge type ignition system for an internal combustion engine according to the present invention, reference numeral 1 designates an ignition coil 1 including a primary winding 1*a* and a secondary winding 1*b*, 2 is an ignition energy accumulating capacitor connected at one end thereof to a non-grounding terminal of the primary winding 1*a*, and 3 is an ignition plug mounted on a cylinder of an internal combustion engine (not shown) and connected to the secondary winding 1*b* of the ignition coil 1.

Reference numeral 4 designates an exciter coil which is arranged in a magneto mounted on the internal combustion engine and of which one end is grounded. The exciter coil 4 has a non-grounding terminal connected to the other end of the capacitor 2 through a diode 5. 6 is a field effect transistor (hereinafter referred to as "FET") constituting a discharge switch, of which a drain is connected to a connection between the capacitor 2 and the diode 5 and a source is grounded through a resistor R0. The resistor R0 has a substantially increased resistance value and constitutes a discharge current detecting circuit 7.

Reference numeral 8 is a signal source for generating a signal Vs containing information for determining ignition timings of the engine. As the signal source, a generating coil arranged in the magneto mounted on the internal combustion engine, a signal coil arranged on a signal generating unit for generating a signal in synchronism with the engine, or the like may be used. The signal source 8 is adapted to generate a pulse-like signal at each of a plurality of predetermined rotation angle positions of the engine. An output of the signal source 8 is fed through a waveform shaping circuit 9 to an ignition timing control unit 10. The signal source 8, waveform shaping circuit 9 and ignition timing control unit 10 cooperated with each other to constitute an ignition signal generating unit.

The signal source 8 may be typically constituted by a signal generator in which a signal coil and a permanent magnet for generating a magnetic flux crossing the signal coil are incorporated and an inductor. The inductor is arranged on an outer periphery of a yoke of a rotor of a magneto, its boss or the like and functions to vary the magnetic flux crossing the signal coil when it is positioned opposite to the signal generator, to thereby induce a signal voltage on the signal coil. Alternatively, a signal generator provided completely separate from the magneto may be often used for this purpose. In addition, a unit in which a hole IC having a hall device incorporated therein is substituted for the signal coil has been recently often used for this purpose.

The ignition timing control unit 10 functions to operate an ignition timing at each of engine speeds of the internal combustion engine by means of a microcomputer including a CPU, a ROM, a RAM and the like and using maps which provide relationships between the engine speeds of the internal combustion engine and the ignition timings thereof, wherein an output signal of the waveform shaping circuit 9 is fed to an input port B1 of the CPU of the microcomputer.

Figure 2:
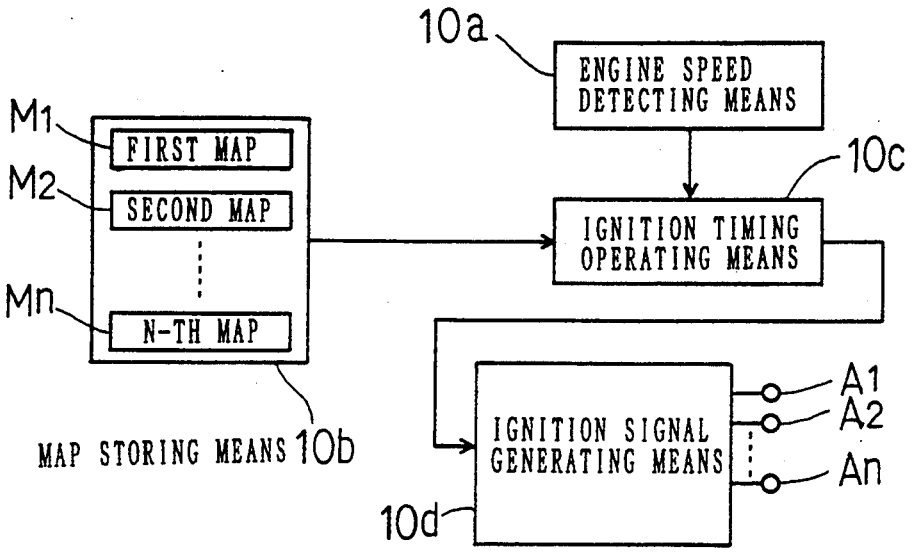
FIG. 2 is a block diagram showing an ignition timing control unit used in the ignition system shown in FIG. 1.

The ignition timing control unit 10, as shown in FIG. 2, includes an engine speed detecting means 10*a* for detecting engine speeds of the internal combustion engine, a map storing means 10b having first to n-th (n: integer of two or more) maps M1 to Mn which provide n kinds of relationships between the engine speeds and the ignition timings stored therein, an ignition timing operating means 10*c* for operating, using the thus-stored first to n-th maps, first to n-th ignition timings with respect to the engine speeds detected by the engine speed detecting means, and an ignition signal generating means 10*d* for generating first to n-th ignition signals at the first to n-th ignition timings thus operated, respectively. In the embodiment illustrated in FIG. 1, n is set to be three (3).

The engine speed detecting means 10*a* functions to read a period of time, which is measured by a timer, required to cause the internal combustion engine to rotate by a predetermined angle of, for example, 360 degrees every time when a specific signal is generated by the signal source 8 to operate an engine speed of the engine, to thereby cause the thus operated engine speed to be stored in the RAM. Data thus stored in the RAM are renewed every time when the signal source generates a specific signal.

The map storing means 10*b* comprises the ROM arranged in the microcomputer. The maps stored in the map storing means 10b provide relationships between an engine speed N of the internal combustion engine and its ignition timings in the form of a table. The first to n-th maps M1 to Mn are prepared so as to cause the ignition timings provided by the maps to coincide with ignition timings which cause peaks to be produced in an output of the internal combustion engine in at least a part of engine speed regions.

In the embodiment of FIG. 1, the relationships between an output of the engine and the ignition timings are as shown in FIG. 5, which indicates that the output exhibits peaks at ignition timings $\theta 1$, $\theta 2$ and $\theta 3$, respectively.

Figure 3:
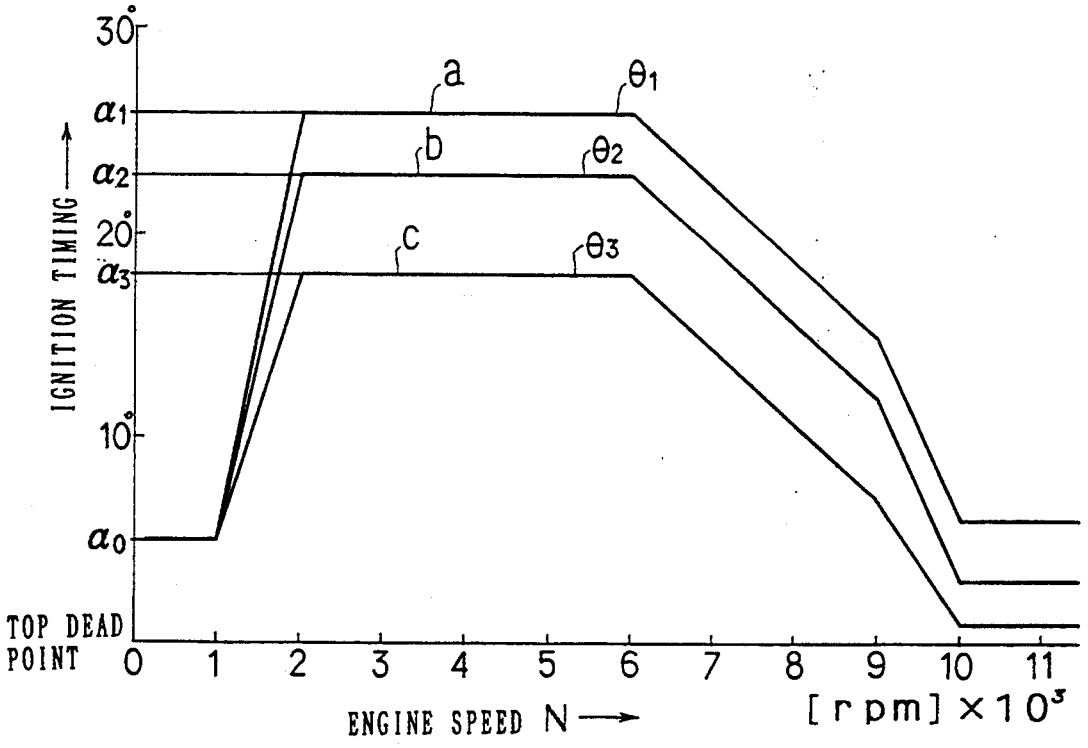
FIG. 3 is a diagram showing relationships between engine speeds provided by maps and ignition timings in the ignition timing control unit of FIG. 2.

In the illustrated embodiment, the maps M1 to M3 are provided, wherein the map M1 is prepared so as to provide such a relationship as indicated at a polygonal line a in FIG. 3 between the ignition timing $\theta 1$ and the engine speeds N. Likewise, the maps M2 and M3 provide relationships as indicated at polygonal lines b and c between the ignition timings $\theta 2$ and $\theta 3$ and the engine speeds N, respectively. Such maps contain data on engine speeds of 1000 rpm, 2000 rpm, 6000 rpm, 9000 rpm and 10000 rpm which provide the polygonal line a with bent portions and ignition timings at the engine speeds. As described above, the maps are prepared on the basis of results of an experiment for obtaining the relationships between an output of the engine and its ignition timings at various engine speeds.

In the example shown in FIG. 3, a relationship of $\theta 1 = \theta 2 = \theta 3$ is established in starting and idling regions below an engine speed of 1000 rpm or less and a relationship of $\theta > \theta > \theta 3$ is established in engine speed regions other than the above. The angles $\theta 1$ to $\theta 3$, as described above, are measured on the advanced side based on the top dead point of the engine.

The ignition timing operating means 10*c* operates, with respect to the respective engine speeds, the ignition timings provided by the first to third maps M1 to M3 by means of the maps.

In the example of FIG. 3, when the engine speed detected is in the starting and idling engine speed regions of 1000 rpm or below, the first to third maps M1 to M3 provide ignition timings $\alpha_0$ equal to each other. Therefore, the ignition timings $\theta 1$ to $\theta 3$ operated by the ignition timing operating means at this time are equal to $\alpha_0$.

When the engine speed detected is within a range of between 2000 rpm and 6000 rpm, the ignition timing operating means 10*c* operates the first to third ignition timings $\theta 1$ to $\theta 3$ as $\alpha_1$, $\alpha_2$ and $\alpha_3$, respectively. Also, in engine speed regions such as a region between 1000 rpm and 2000 rpm and that between 6000 rpm and 10000 rpm, in which the ignition timings are varied depending on the engine speeds, the ignition timings $\theta 1$ to $\theta 3$ at the respective engine speeds are operated by interpolation techniques using data on the bent portions read out from the maps. Such data on the ignition timings are stored in the RAM in the form of counted values of clock pulses which an ignition timing measuring timer measures between a specific rotation angle position at which the signal source 8 generates a specific signal and the respective ignition timings.

The ignition signal generating means 10*d* includes first to third ignition timing measuring timers (not shown), so that it concurrently sets counted values providing the first to third ignition timings $\theta 1$ to $\theta 3$ in the timers when the signal source 8 generates a signal at a specified rotational angle position. The first to third ignition timing measuring timers change electric potentials at output ports A1 to A3 of the CPU when it completes counting of set values, resulting in first to third ignition signals being generated, respectively. The embodiment of FIG. 1 is constructed so as to change an potential at each of the output ports A1 to A3 to a high level when the first to third ignition timing measuring timers of the ignition signal generating means 10*d* complete counting, leading to generation of ignition signal Vg1 to Vg3 (FIGS. 4(B) to 4(D)).

The ignition signals thus generated are fed to the discharge switch control circuit 11. The discharge switch control circuit 11 controls the FET 6 so that the FET 6 is rendered turned on when the ignition timing control unit 10 generates the first to n-th ignition signals and turned off when a discharge current detected by the discharge current detecting circuit 7 reaches a predetermined value. The discharge switch control circuit 11 used in the embodiment of FIG. 1 comprises a comparator CP1, transistors Tr1 and Tr2, programmable unijunction transistors PUT1 to PUT3, diodes D1 to D3, and resistors R1 to R9.

Also, the illustrated embodiment includes a damper diode 12 connected in parallel to the primary winding la of the ignition coil 1. The damper diode 12 is connected in a direction which permits a voltage induced across the primary winding la to be applied in a forward direction when discharge of the ignition energy accumulating capacitor 2 is interrupted.

Terminals indicated at reference character E in FIG. 1 each are connected to an output terminal of a DC power supply (not shown) which has a positive polarity. The DC power supply may comprises a battery. Alternatively, it may comprise the exciter coil 4, a rectifier circuit for rectifying an output of the exciter coil 4, and a constant voltage circuit for carrying out controlling so as to keep an output voltage of the rectifier circuit substantially constant.

Now, the manner of operation of the illustrated embodiment will be described hereinafter.

The ignition energy accumulating capacitor 2 is charged with electricity of polarities shown in FIG. 1 through the diode 5 by means of an output voltage of a half cycle of the exciter coil 4, so that a voltage Vc across the capacitor 2 is increased as shown in FIG. 4(G). Vc in FIG. 4(G) indicates a voltage at a connection between the capacitor 2 and the FET 6.

The signal source 8, as shown in FIG. 4(A), generates signals Vs1 and Vs2. In the illustrated embodiment, the signal Vs1 is set so as to reach a threshold level at a maximum advanced position of the engine and the signal Vs2 reaches a threshold level at a minimum advanced position of the engine. The ignition timing control unit 10 detects engine speeds by means of the thus-generated signals, so that the ignition timing measuring timers are started at the time of generation of any one of the signals to generate first to third ignition signals Vg1 to Vg3 at the output ports A1 to A3 at ignition timings operated by the maps, respectively.

The comparator CP1 of the discharge switch control circuit 11 is fed at an inversion input terminal thereof with a discharge current detecting signal Vd (FIG. 4(F)) obtained across the resistor R0 and at a non-inversion input terminal thereof with a reference voltage Vr obtained by dividing an output voltage of the above-described DC power supply (not shown) by the resistors R8 and R9. A discharge current detecting signal Vd obtained across the resistor R0 before discharge of the capacitor 2 starts is zero, therefore, an output of the comparator CP1 is kept at a high level, so that the transistors PUT1 to PUT3 are kept non-conductive.

Then, when ignition timing comes under such conditions, the ignition timing control unit 10 first generates the first ignition signal Vg1 (FIG. 4(B)) at the output port A1. The ignition signal Vg1 is then fed through the resistor R1, diode D1 and resistor R4 to a base of the transistor Tr1, so that the transistor Tr1 is rendered conductive and the transistor Tr2 is rendered conductive. When the transistor Tr2 is rendered conductive, a voltage Vt (FIG. 4(E)) is applied from the DC power supply (not shown) through the transistor Tr2 and resistor R6 to a gate of the FET 6, resulting in the FET 6 being turned on. This causes charges in the capacitor 2 to be discharged through the FET 6, the resistor R0 and the primary winding 1*a* of the ignition coil 1, so that a high voltage may be induced across the secondary winding 1*b* of the ignition coil 1. The high voltage thus induced is then applied to the ignition plug 3, to thereby cause the ignition plug 3 to generate sparks, leading to ignition of the engine.

Such discharge of the capacitor 2 causes the discharge current detecting signal Vd obtained across the resistor R0 to be increased. Thus, when the signal Vd exceeds the reference voltage Vr, the output of the comparator CP1 is caused to be at a ground level. This causes a current to flow between an anode of the transistor PUT1 and its gate, to thereby cause the transistor PUT1 to be conductive. Therefore, the transistor Tr1 is rendered non-conductive, to thereby cause the transistor Tr2 to be non-conductive, so that application of a voltage to a gate of the FET 6 is interrupted to render the FET turned off. Thus, discharge of the ignition energy accumulating capacitor 2 is interrupted when the discharge current reaches a predetermined value. The predetermined value of the discharge current may be adjusted as desired depending on a magnitude of the reference voltage Vr. When discharge of the capacitor 2 is interrupted, the voltage across the resistor R0 is caused to be zero, to thereby change the output of the comparator CP1 to a high level. However, the transistor PUT1 continues flowing of the current for a period of time during which the ignition signal Vg1 is kept at a high level, to thereby keep the transistor Tr1 non-conductive.

Then, when the ignition timing control unit 10 generates the second ignition signal Vg2 (FIG. 4(C)), the second ignition signal Vg2 is fed through the resistor R2, diode D2 and resistor R4 to the base of the transistor Tr1, so that the transistor Tr1 is rendered conductive and the transistor Tr2 is rendered conductive. This causes a voltage to be applied to the gate of the FET 6, to thereby render the FET 6 turned on, so that charges remaining in the capacitor 2 are discharged through the FET 6, the resistor R0 and the primary winding la of the ignition coil 1, resulting in second ignition being carried out.

Such discharge of the capacitor 2 causes the discharge current detecting signal Vd obtained across the resistor R0 to be increased. Thus, when the signal Vd exceeds the reference voltage Vr, the output of the comparator CP1 is caused to be at a ground level, so that the transistor PUT2 is rendered conductive to cause the transistor Tr1 to be non-conductive. This causes the transistor PUT2 to be conductive to render the transistor Tr1 non-conductive. This results in the transistor Tr2 being non-conductive and the FET 6 being turned off, so that discharge of the capacitor 2 is interrupted. Such interruption of discharge of the capacitor 2 causes the discharge current detecting signal Vd to be zero, to thereby change the output of the comparator CP1 to a high level. However, the transistor PUT2 continues flowing of the current for a period of time during which the ignition signal Vg2 is kept at a high level, to thereby keep the transistor Tr1 non-conductive.

Then, when the third ignition signal Vg3 is generated, it is fed through the resistor R3 and diode D3 to the transistor Tr1, so that the transistors Tr1 and Tr2 are rendered conductive, leading to turning-on of the FET 6. This results in charges remaining in the capacitor 2 being discharged through the FET 6, the resistor R0 and the primary winding 1*a* of the ignition coil 1, so that third ignition may be accomplished.

In the embodiment of FIG. 1, as described above, ignition is carried out at the first to third ignition timings in each ignition operation, leading to multiple ignition. The first to third ignition timings are set so as to substantially coincide with three ignition timings which cause peaks to be produced in an output of the engine. Therefore, even when the first ignition fails in starting of the engine under conditions that a concentration of fuel is reduced at the time of quick acceleration of the engine, the subsequent second or third ignition succeeds in starting of the engine to permit the engine to generate an output of a satisfactory level. Thus, the illustrated embodiment effectively prevents an output of the engine from being substantially reduced at the time of quick acceleration of the engine.

In the illustrated embodiment, the above-described predetermined value of the discharge current of the capacitor, which depends on the reference voltage Vr, is set to be, for example, a value approximating to a minimum value of a current range which permits a core of the ignition coil 1 to be magnetically saturated. Such setting of the predetermined value prevents a reduction in secondary output of the ignition coil even when discharge of the capacitor is interrupted, so that a crest value of a high voltage induced across the secondary winding of the ignition coil at the ignition timing is substantially equal to that in the prior art.

Discharge of the ignition energy accumulating capacitor 2 can be repeatedly carried out so long as there remain charges in the capacitor 2, and the number of times (n) of ignition which can be carried out in one ignition operation may be suitably set depending on a capacity of the capacitor 2. Also, the number of times of ignition in each of ignition operations may be suitably set depending on a type of the engine intended.

In the embodiment described above, the FET 6 is used as the discharge switch. However, it is merely required that the discharge switch provides a control terminal thereof with a predetermined signal, resulting in interruption; therefore, any other switching element such as a transistor or the like may be conveniently used for this purpose.

In the illustrated embodiment, the output of the exciter coil 4 is used for charging of the ignition energy accumulating capacitor. Alternatively, in the present invention, it is possible to carry out charging of the ignition energy accumulating capacitor using a DC-DC converter which is capable of increasing a voltage of a battery.

Also, the illustrated embodiment is adapted to cause the first to third ignition timings to be equal to each other during idling, resulting in ignition being carried out only one time. However, in ignition of an engine which requires to increase a duration of the secondary discharge current during idling, multiple ignition may be carried out during idling as well.

Further, depending on the engine, ignition in any region other than the idling region may be carried out only one time. Alternatively, the number of times of ignition may be varied depending on the engine speed region.

The embodiment described above requires only one such ignition energy accumulating capacitor and only one such discharge switch, to thereby significantly simplify the ignition circuit. Also, charging is merely required with respect to only one such ignition energy accumulating capacitor, so that a power supply of a decreased capacity may be used for charging of the capacitor. Thus, it will be noted that the illustrated embodiment enhances ignition performance to a degree sufficient to ensure complete combustion even when a concentration of fuel is reduced, while preventing the ignition system from being large-sized.

Figure 6:
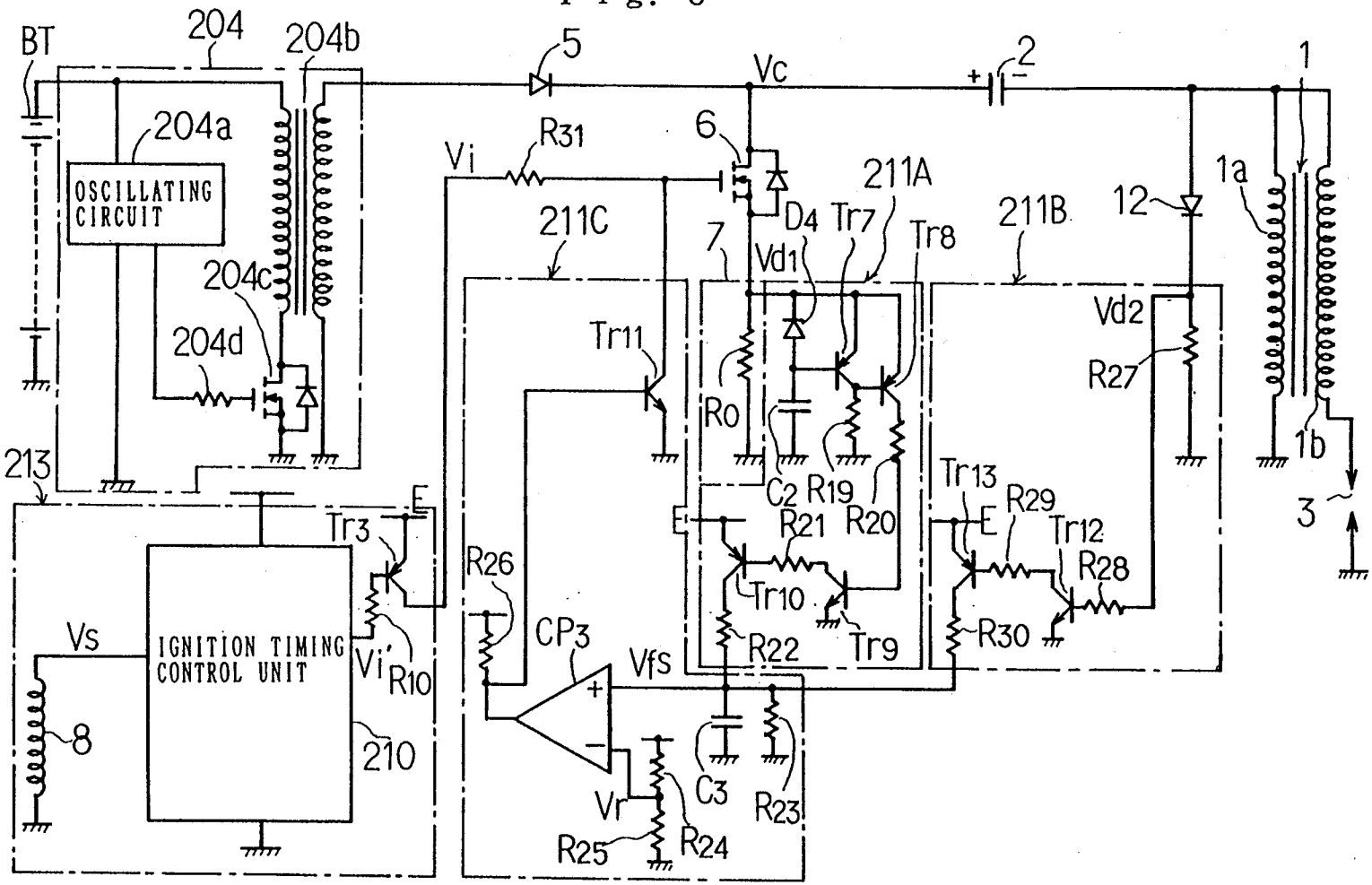
FIG. 6 is a further embodiment of a capacitor discharge type ignition system for an internal combustion engine according to the present invention.

Referring now to FIG. 6, a further embodiment of a capacitor discharge type ignition system for an internal combustion engine according to the present invention is illustrated, wherein parts corresponding to those in the embodiment of FIG. 1 are likewise designated by like reference numerals.

Reference character BT designates a battery and 204 is a voltage increasing circuit (DC-DC converter) for increasing an output voltage of the battery BT. The voltage increasing circuit 204 includes a pulse oscillating circuit **204*a* which is driven by the battery BT to generate rectangular pulses, a transformer 204*b* and a field-effect transistor (FET) 204*c* of which a drain-source circuit is connected in series to a primary winding of the transformer 204*b*, and is so constructed that a voltage of the battery BT is applied across a series circuit comprising the primary winding of the transformer 204*b* and the FET 204C. An output of the oscillating circuit 204*a* is fed through a resistor 204*d* to a gate of the FET 204*c*, to thereby subject the FET 204*c* to on-off control. An output voltage of the transformer 204*b* is applied through a diode 5 across a series circuit comprising an ignition energy accumulating capacitor 2 and a primary winding 1*a* of an ignition coil 1. A circuit circulating from a secondary winding of the transformer 204*b* through the diode 5, the capacitor 2 and the primary winding la of the ignition coil 1 to the secondary winding of the transformer 204*b*** constitutes a capacitor charging circuit.

An ignition timing control unit 210 is fed with an output of a signal source 8 to operate ignition timings at engine speeds of an internal combustion engine. Then, the unit 210 causes a level of an electric potential Vi' at an output terminal thereof to be zero at the ignition timings operated, to thereby cause a current to flow through a base of a transistor Tr3. This causes the transistor Tr3 to be conductive at the ignition timings, to thereby provide a discharge switch described hereinafter with an ignition signal Vi. Thus, the signal source 8, ignition timing control unit 210, transistor Tr3 and resistor R10 cooperate with each other to constitute an ignition signal generating unit 213.

A current detecting resistor R0 includes a non-grounding terminal to which emitters of PNP transistors Tr7 and Tr8 are commonly connected. Between an emitter of the transistor Tr7 and its base is connected a diode D4 of which a cathode is connected to the emitter of the transistor Tr7. Between the base of the transistor Tr7 and the ground is connected a peak detecting capacitor C2 and between a collector of the transistor Tr7 and the ground is connected a resistor R19. The transistor Tr8 is connected at a base thereof to the collector of the transistor Tr7 and at a collector thereof through a resistor R20 to a base of an NPN transistor Tr9. Also, the transistor Tr9 is grounded at an emitter thereof and connected at a collector thereof through a resistor R21 to a base of a PNP transistor Tr10. Also, the transistor Tr10 is connected at an emitter thereof to a positive terminal of the battery BT and at a collector thereof to one end of a resistor 22. Between the other end of the resistor R22 and the ground are connected a capacitor C3 and a resistor R23 in parallel, and a voltage across the capacitor C3 is fed to a non-inversion input terminal of a comparator CP3. The non-inversion input terminal of the comparator CP3 is fed with a set voltage Vr obtained by dividing the voltage of the battery BT by a voltage dividing circuit comprising resistor R24 and R25. An output terminal of the capacitor CP3 is connected to a base of an NPN transistor Tr11 of which an emitter is grounded and a collector is connected to a gate of the FET 6. The output terminal of the comparator CP3 is also connected through a resistor R26 to a positive terminal of the battery BT.

Also, to the primary winding la of the ignition coil 1 is connected a damper diode 12 in parallel. The damper diode 12 is connected in a direction which permits a voltage induced across the primary winding la of the ignition coil 1 when discharge of the ignition energy accumulating capacitor 2 is interrupted to be applied in a forward direction, and a current detecting resistor R27 is connected in series to the diode 12. A connection between the resistor R27 and the diode 12 is connected through a resistor R28 to a base of a PNP transistor Tr12 of which an emitter is grounded and a collector is connected through a resistor R29 to a base of a PNP transistor Tr13. Also, the transistor Tr13 is connected at an emitter thereof to the positive terminal of the battery BT and at a collector thereof through a resistor R30 to the non-inversion input terminal of the comparator CP3.

In the illustrated embodiment, the resistors R0, R19, R20, R21 and R22, transistors Tr7, Tr8, Tr9 and Tr10, and capacitor C2 cooperate with each other to constitute a discharge interruption command circuit 211A. Also, the resistors R27, R28 and R29 and transistors Tr12 and Tr13 cooperate with each other to form a discharge restart command circuit 211B which is adapted to generate a discharge restart command signal when a current flowing through the damper diode 12 reaches a reference value or less. Further, the comparator CP3, resistors R24, R25 and R26, and transistor Tr11 constitute a trigger signal feed control circuit 211C in cooperation with each other. The gate of the FET 6 is connected through a resistor R31 to a collector of the transistor Tr3.

Figure 7:
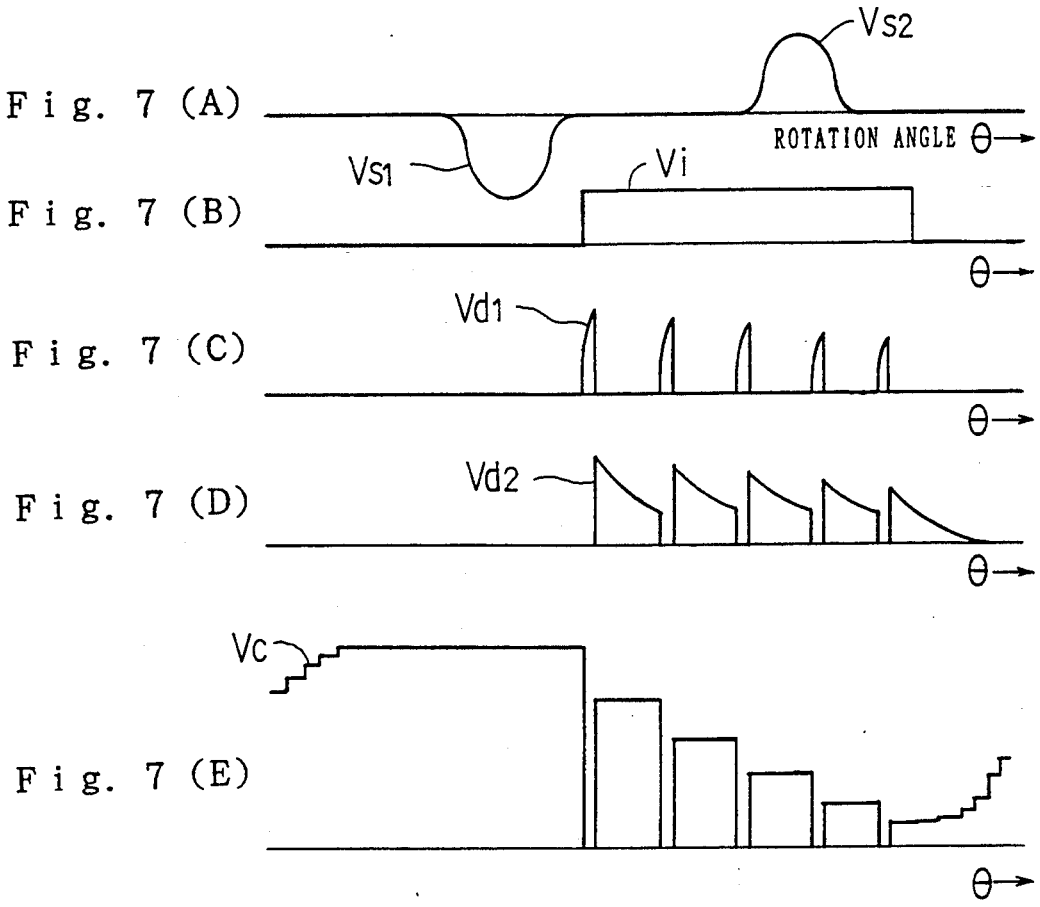
FIGS. 7(A) to 7(E) each are a waveform chart showing a waveform of a voltage at each of parts of the ignition system shown in FIG. 6.

In the illustrated embodiment, the ignition energy accumulating capacitor 2 is charged with electricity of polarities shown in FIG. 6 by means of an output voltage of the voltage increasing circuit 204 through the diode 5, so that a voltage Vc across the capacitor 2 is stepwise increased as shown in FIG. 7(E). Reference character Vc in FIG. 7(E) indicates a potential at a connection between the capacitor 2 and the FET 6.

The signal source 8, as shown in FIG. 7(A), generates signals Vs1 and Vs2 containing information for determining ignition timings. In the illustrated embodiment, the signal Vs1 is set so as to reach a threshold level at a maximum advanced position of the engine and the signal Vs2 is set so as to reach a threshold level at a minimum advanced position of the engine. The signals Vs1 and Vs2 are fed to the ignition timing control unit 210, so that it causes the transistor Tr3 to be conductive at ignition timings of the engine, resulting in feeding an ignition signal Vi through the transistor Tr3 and resistor R3 as shown in FIG. 7(B). Rising of the ignition signal Vi causes the FET 6 to be turned on, resulting in charges in the capacitor 2 being discharged to the primary winding la of the ignition coil 1. Such discharge of the capacitor 2 causes a detection voltage Vd1 of about 1 to 4 V proportional to a discharge current of the capacitor 2 to appear across the resistor R0 as shown in FIG. 7(C). The detection voltage Vd1 causes a current to flow from the emitter of the transistor Tr7 through its base to the peak detecting capacitor C2, resulting in the transistor Tr7 being conductive. The transistor Tr8 is kept non-conductive for a period of time during which the transistor Tr7 is kept conductive. A discharge current of the capacitor C2 reaches its peak value when a predetermined period of time elapses after starting of the discharge. When the discharge current reaches the peak, discharge of the capacitor C2 is interrupted. At this time, an electric potential at the base of the transistor Tr7 is caused to be substantially equal to an electric potential at its emitter, resulting in the current flowing through the base of the transistor Tr7 being zero, so that the transistor Tr7 is rendered non-conductive. This causes the transistors Tr9 and Tr10 to be conductive, resulting in a discharge interruption command signal Vfs being fed from the battery BT through the transistor Tr10 and resistor R22. The capacitor C3 is charged by the discharge interruption command signal Vfs. The discharge interruption command signal Vfs is set to be higher than the set voltage Vr, so that an electric potential at the output terminal of the comparator CP3 is caused to be at a high level. This causes the transistor Tr11 to be conductive to subject the gate of the FET 6 to grounding, so that the FET 6 is turned on, resulting in charges in the capacitor C2 being discharged through a diode D4 and resistor R0.

When discharge of the ignition energy accumulating capacitor 2 is interrupted, a voltage of a polarity which is to further continue flowing of the current is induced across the primary current 1*a* of the ignition coil 1, to thereby cause a current to flow through the diode 12 and current detecting resistor R27. Therefore, across the resistor R27 is induced a voltage Vd2 proportional to the current flowing through the damper diode 12, as shown in FIG. 7(D). The transistor Tr12 and Tr13 are kept conductive during a period of time for which the voltage Vd2 exceeds a predetermined value, so that a discharge interruption command signal of substantially the same level as that of the discharge interruption command signal Vfs is fed from the battery BT through the transistor Tr13 and resistor 30 to the comparator CP3. Thus, the transistor Tr11 is kept conductive and the FET 6 is kept turned off. When the current flowing through the diode 12 is decreased to a predetermined reference value or less and the voltage Vd2 is reduced to a reference value or less, the transistors Tr12 and Tr13 are rendered non-conductive. In the illustrated embodiment, an output of a zero level of the transistor Tr13 constitutes the discharge restart command signal. More particularly, when the transistor Tr13 is rendered non-conductive, charges in the capacitor C3 are discharged through the resistor R23, so that the voltage input to the non-inversion input terminal of comparator CP3 reaches a level of the set voltage Vr or less. At this time, the output of the comparator CP3 is lowered to a low level, so that the transistor Tr11 is rendered non-conductive. Thus, when feeding of the ignition signal Vi is continued, the FET 6 is turned on again, to thereby restart discharge of the capacitor 2. The above-described operation is repeated, so that so long as feeding of the ignition signal Vi is continued, discharge of the capacitor 2 is repeated at predetermined time intervals as shown in FIG. 7(C), to thereby cause a current to flow through the damper diode 12 as shown in FIG. 7(D) every time when discharge of the capacitor 2 is interrupted. The current flowing through the damper diode 12 is proportional to a secondary discharge current of the ignition coil 1. The potential Vc at the connection between the capacitor 2 and the FET 6 is stepwise reduced every time when the discharge is carried out, as shown in FIG. 7(E).

When discharge of the capacitor is intermittently carried out plural times as described above, a duration of the secondary discharge current can be prolonged while repeatedly inducing the secondary voltage rapidly rising, to thereby significantly improve ignition performance. The number of turns of the primary winding of the ignition coil may be set to be 50 to 80 as in the conventional typical capacitor discharge ignition system, thus, the present invention eliminates a necessity of using a large-sized ignition coil.

In the illustrated embodiment, the discharge interruption command circuit 211A is constructed so as to generate a discharge interruption command signal when the discharge current reaches its peak. However, construction of the discharge interruption command signal is not limited to such a manner. Any desired circuit can be used as the discharge interruption command circuit so long as it can detect a peak of a current to generate a signal.

The discharge interruption command circuit is not necessarily required to generate a discharge interruption command signal whenever the discharge current reaches its peaks. It may be constructed so as to generate a discharge interruption command signal when the discharge current reaches a predetermined value.

In the illustrated embodiment, the FET **204*c* is used as switching element for carrying out on-off control of the primary current of the voltage increasing circuit 204. However, any other switching element such as a transistor or the like may be conveniently used for the circuit 204** so long as it can carry out on-off control of the primary current of the transformer.

Also, in the illustrated embodiment, a DC-DC converter is used for charging of the ignition energy accumulating capacitor. Alternatively, in the present invention, the ignition energy accumulating capacitor may be charged by means of an output of the exciter coil arranged in the magneto.

Further, for the purpose of ignition of an internal combustion engine in which it is required to increase a duration of the secondary discharge current in a predetermined engine speed region such as, for example, during idling, the present invention may be constructed so as to permit the discharge restart command signal to be generated only in a low engine speed region and prevent the discharge restart command signal from being generated in a high engine speed region. This may be accomplished, for example, by causing the ignition timing control circuit 210 to generate a trigger signal and feeding the so-generated trigger signal to the transistor Tr12, to thereby forcibly keep the transistors Tr12 and Tr13 conductive.

In a high engine speed region, when generation of the discharge restart command signal is interrupted to carry out discharge of the ignition energy accumulating capacitor only one time, charges remain in the ignition energy accumulating capacitor 2 even after the ignition, to thereby prevent a value of a secondary voltage of the transformer of the DC-DC converter from being zero. This permits a decrease in current flowing on the primary side of the transformer, to thereby significantly reduce generation of heat in the transformer **204*b*** and the control circuit for a primary current of the transformer.

Further, the illustrated embodiment may be constructed so as to prevent complete discharge of the ignition energy capacitor even when discharge of the capacitor is repeated plural times. Such construction permits a load imposed on the DC-DC converter to be reduced.

Moreover, the illustrated embodiment, as described above, is so constructed that the discharge restart command circuit 211B successively generates a discharge interruption command signal after the discharge interruption command circuit 211A generates a discharge interruption command signal, so that the discharge switch or FET 6 is kept turned off. Alternatively, the illustrated embodiment may be constructed, for example, in a manner to permit the discharge interruption command circuit 211A to continuously generate a discharge interruption command signal when the discharge current of the ignition energy accumulating capacitor reaches a predetermined value and permit a discharge restart command signal generated by the discharge restart command circuit to interrupt generation of the discharge interruption command signal, resulting in the discharge switch 6 being re-conductive.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A capacitor discharge type ignition system for an internal combustion engine, comprising:

an ignition energy accumulating capacitor arranged on a primary side of an ignition coil;

a capacitor charging circuit for charging said ignition energy accumulating capacitor with electric charges;

a discharge switch for discharging the electric charges in said ignition energy accumulating capacitor to a primary winding of said ignition coil when it is rendered conductive;

an ignition signal generating unit for generating an ignition signal for determining each of ignition timings of the internal combustion engine;

a discharge current detecting circuit for detecting a discharge current of said ignition energy accumulating capacitor;

said ignition signal generating unit comprising an engine speed detecting means for detecting engine speeds of the internal combustion engine;

a map storing means in which first to n-th (n: integer of 2 or more) maps for defining n kinds of relationships between the engine speeds and the ignition timings are stored;

said first to n-th maps being prepared so as to permit the ignition timings defined by the respective maps to coincide with the ignition timings which produce peaks in an output of the internal combustion engine in at least a part of engine speed regions;

an ignition timing operation means for operating the ignition timing defined by each of said maps with respect to each of the engine speeds by means of said first to n-th maps;

an ignition signal generating means for generating an ignition signal at each of the ignition timings operated by said ignition timing operation means; and a discharge switch control circuit for controlling said discharge switch in a manner to render said discharge switch conductive to start discharge of said ignition energy accumulating capacitor when said ignition signal is generated, and render said discharge switch non-conductive to interrupt discharge of said ignition energy accumulating capacitor when the discharge current detected by said discharge current detecting circuit reaches a predetermined value.

2. A capacitor discharge type ignition system as defined in claim 1, further comprising a damper diode connected in parallel to said primary winding of said ignition coil.

* * * * *

UNITED STATES PATENT AND TRADEMARK OFFICE

CERTIFICATE OF CORRECTION

PATENT NO. : 5,433,184

DATED : July 18, 1995

INVENTOR(S) : Kinoshita et al.

It is certified that error appears in the above-identified patent and that said Letters Patent is hereby corrected as shown below:

Title page, item [73] should read --

"Assignee: Kokusan Denki Co., Ltd., Shizuoka-Ken, Japan".

Title page, col. 2, regarding the information about the attorney, agent, or firm, the following information should be inserted:

"Attorney, Agent, or Firm--Pearne, Gordon, McCoy & Granger".

Column 4, line 59, after "below" insert --,--.

Column 15, line 59, "4 V" should read --4V--.

Signed and Sealed this

Twelfth Day of December, 1995

*Attest:*

*Attesting Officer*

Bruce Lehman

BRUCE LEHMAN

*Commissioner of Patents and Trademarks*